US007997994B2

(12) United States Patent
Hensel

(10) Patent No.: US 7,997,994 B2
(45) Date of Patent: Aug. 16, 2011

(54) GOLF SWING TRAINING AID

(76) Inventor: Michael J. Hensel, Pittsburgh, PA (US)

( * ) Notice: Subject to any disclaimer, the term of this patent is extended or adjusted under 35 U.S.C. 154(b) by 0 days.

(21) Appl. No.: 12/726,387

(22) Filed: Mar. 18, 2010

(65) Prior Publication Data

US 2010/0248855 A1 Sep. 30, 2010

Related U.S. Application Data

(60) Provisional application No. 61/161,878, filed on Mar. 20, 2009.

(51) Int. Cl.
*A63B 69/36* (2006.01)

(52) U.S. Cl. ..... 473/257; 473/278

(58) Field of Classification Search ..... 473/218, 473/257, 261, 262, 266, 268, 270, 273, 278, 473/422

See application file for complete search history.

(56) References Cited

U.S. PATENT DOCUMENTS 3,868,116 A * 2/1975 Ford et al. ..... 473/218
4,526,373 A * 7/1985 Medlock ..... 473/265
5,014,994 A * 5/1991 Peters ..... 473/218
5,882,267 A * 3/1999 Roe ..... 473/265
6,746,340 B1 6/2004 Dover
6,840,870 B1 * 1/2005 Froggatte ..... 473/265
6,913,544 B2 7/2005 Tiffin
7,214,140 B2 5/2007 Coombs
7,384,346 B2 6/2008 McFarlin
7,448,956 B2 11/2008 Mitchell
2006/0128493 A1 6/2006 Snopkowski
2009/0197693 A1 8/2009 Hooper
2009/0280922 A1 11/2009 Zhou

* cited by examiner

*Primary Examiner* — Nini Legesse
(74) *Attorney, Agent, or Firm* — McKay & Associates, P.C.

(57) ABSTRACT

A golf swing training aid to assist golfers with multiple skills required in the game of golf and assist the golfer in creating a repeatable impact position with all golf shots. A short portion and a parallel long portion both connect to a rear portion and define a channel. The short portion is shorter than the long portion to form a J-shaped mat. A golf ball is placed between the two portions at designated markers depending on the type of golf iron used, and the size of the divot resulting from impact can be estimated using the one or more other markers along the short and long portion to help evaluate the swing and direction of the golf club as a result of the size and direction of the divot.

8 Claims, 1 Drawing Sheet

GOLF SWING TRAINING AID

CROSS-REFERENCE TO RELATED APPLICATIONS

The instant application hereby claims benefit of provisional application, Ser. No. 61/161,878, filed Mar. 20, 2009, the disclosure of which is herein incorporated by reference.

BACKGROUND

1. Field of the Invention

The present invention is in the technical field of golf instruction. More particularly, the present invention is in the technical field of golf swing instructional aids of the mat-type for disposition on the ground.

2. Description of the Related Art

Known in the art are golf swing practice mats which allow a user to practice his or her golf swing and which evaluate swing planes. For example, U.S. Patent Publication No. 20090280922 shows a golf swing practice target panel and method of using in which the impact device includes a panel made of a type of material such that there will be a temporary mark where a standard or non-standard golf ball impacted the panel. An aiming reference point may be provided on a lower portion of the panel. In addition, lines may be printed on the panel to depict launch or elevation angles and off-center deviation angles. U.S. Publication No. 20090197693 is a golf practice mat for use by a golfer which has surface indication in its upper surface formed by heat-deforming the upper surface to assume a deformed shape and allowing the upper surface to set in the deformed shape. U.S. Pat. No. 7,448,956 describes a swing plane indicating golf mat for diagnosing out-of-plane golf swings having grass-mimicking blades toggling from one stable state to another state when blades are struck by the club face, where one state distinguishable from another state. U.S. Pat. No. 7,384,346 is a golf practice device having a divot simulator insert installed in a cavity area of a platform member, where the insert has a hitting surface that yields and moves when impacted by head of golf club during golf swing. U.S. Pat. No. 7,214,140 similarly shows a golfer training aid for practicing a golf swing which has an on-mat swing channel defined between opposing uprights that project from the upper surface of the planar mat, and an off-mat swing channel that is defined by edges of a cut-away portion of the planar mat. U.S. Publication No. 20060128493 teaches a divot indicating golf practice device for providing indication of where the golf club strikes the mat, comprising a mat made up of synthetic turf fibers that emulate natural grass and configured with indicators to provide visual feedback to golfer. U.S. Pat. No. 6,746,340 describes a golf divot practice mat used by a golfer for practicing putting, which has a divot patch with a front edge secured to a rubber base by clamps or fasteners so that the divot patch does not separate from the base when its rear edge is hit by the golf club. Finally, U.S. Pat. No. 6,913,544 shows a golf or divot practice mat for improving golf skills, comprising a mark retaining surface for recording impressions resulting from contact with a golf club head.

As can been seen, prior golf-training aids for golf swings, namely evaluating and correcting out-of-plane swings, are not typically adapted to be used on natural surfaces, rather artificial mats with synthetic material depicts the tee-box surface and impact results. Moreover, prior devices do not specifically evaluate divot size for purposes of impact-dynamics. Finally, prior art training devices are cumbersome, expensive, and not suited to accompany the golfer during an actual golf round on a golf course. These and other problems are solved by the instant invention, as follows.

SUMMARY

Many golfers with varying skill levels have trouble striking the golf ball with a descending blow, thus not compressing the ball and having proper shaft lean left at impact to ensure a short, inside strike. They often strike behind the ball hitting the ground short, inside or hit with an ascending blow. This causes inconsistency in distance control and trajectory.

The present invention is a golf training mat adapted to be used on a natural surface, generally J-shaped as follows, to assist golfers with multiple skills required in the game of golf and assist the golfer in creating a repeatable impact position with all golf shots. The training mat will assist with multiple aspects in the golf swing related to alignment, distance control, consistency, putting, short game, ball position, impact zone and divot size. Critically J-shaped, the instant golf training mat will assist golfers with applying power and accuracy to the golf ball by allowing the golfer to learn the proper unloading of the shaft by forcing the golfer to maintain an angle between the left arm and shaft, forcing the hands to reach the impact area before the club (shaft lean towards target).

Accordingly, provided is a golf swing training aid, comprising a rear portion and a short portion integral with and extending from the rear portion. The short portion is defined by a linear short inside edge, a short outside edge parallel to the short inside edge, and a short end edge joining the short inside edge to the short outside edge. Then a long portion parallel to the short portion is also integral with and extending from the rear portion defined by a linear long outside edge and a long inside edge parallel to the long outside edge, the long portion extending longer than the short portion relative to the rear portion. Long portion terminates to form a directional indicator, which joins the long outside edge to the long inside edge. An arched edge then joins the short inside edge to the long inside edge. Finally, a bottom edge joins the short outside edge to the long outside edge, thereby forming a J-shaped mat having a distance between the short inside edge of the short portion and the long inside edge of the long portion defined by the arched edge with this distance being slightly wider than the width of a golf club iron. Of note is that the short inside edge of the short portion has a length which is slightly longer than the length of a golf swing divot. Accordingly, a golf ball is placed between the two portions at designated markers depending on the type of golf iron used, and the size of the divot resulting from impact can be estimated using the one or more other markers along the short and long portion. Specifically, at least one iron indicator is disposed on either of the long portion or the short portion situated to align with the golf ball, and a means disposed on the mat for measuring a divot within the natural surface resulting from impact can help evaluate the swing and direction of the golf club as a result of the size and direction of the divot.

DETAILED DESCRIPTION OF THE PREFERRED EMBODIMENT

Figure 1:
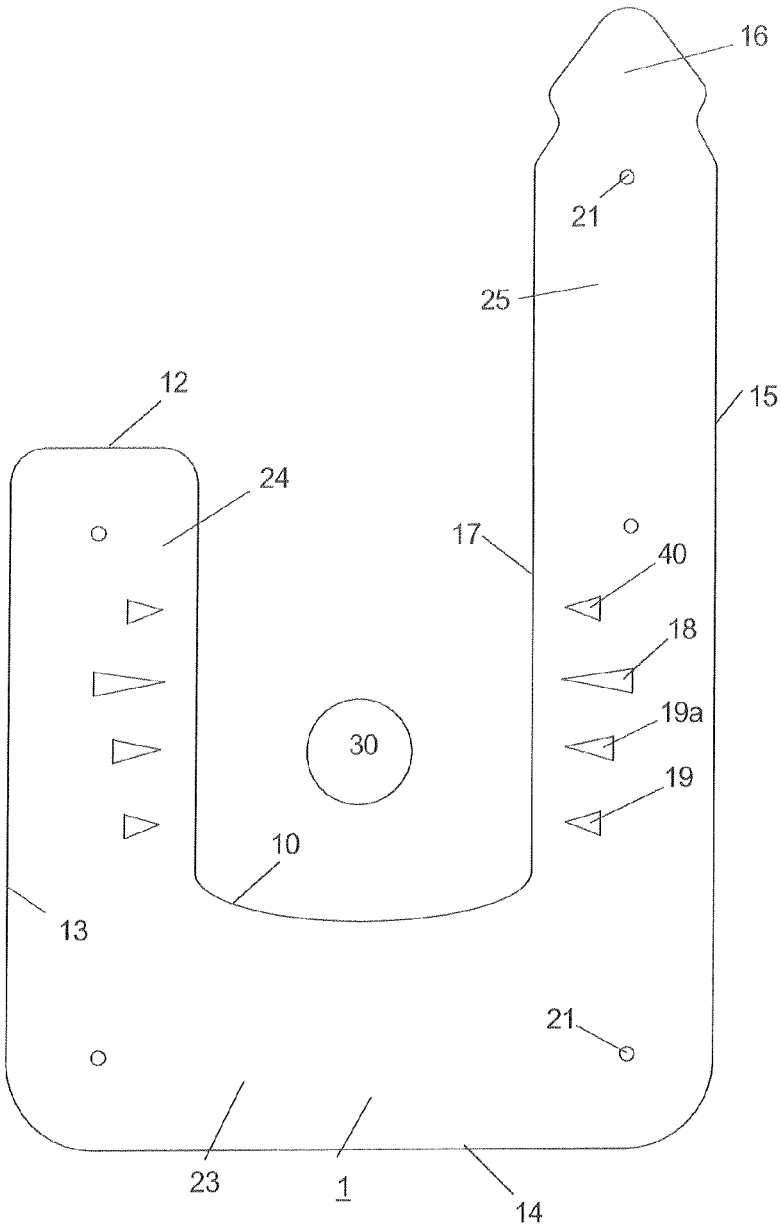
FIG. 1 is a top view of a golf swing training mat of the present invention for a right hand golfer.
Figure 2:
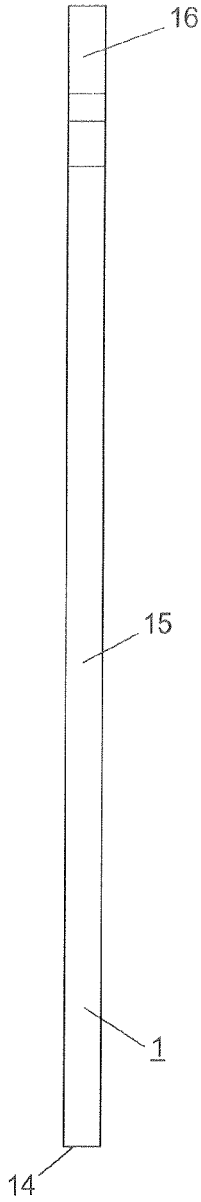
FIG. 2 is a side view of a golf swing training mat of the present invention.

With reference then to FIGS. 1 and 2, shown is the golf swing training aid of the instant invention, generally formed as a mat 1. Critical is that the mat 1 is J-shaped and adapted to be placed on the ground. "Ground" as used herein means any natural surface such as an actual grass golf course tee box or even a green if the device is used to putt. Although the mat 1 can be placed on any artificial surface such as a driving range turf, important is that a natural divot be created by a user's golf swing, as will be discussed. Mat 1 can be made of a flexible or rigid material that is durable enough to withstand multiple impacts of a golf club and is preferably made of a bright color to remain easily visible to the user, but non-opaque, or slightly translucent so that some identifying ground textures remain somewhat visible.

As shown, mat 1 which makes up the instant golf swing training aid, being J-shaped it includes a rear portion 23, a short portion 24, and a long portion 25. Short portion 24 is integral with the rear portion 23 extending therefrom defined by a linear short inside edge 11, a short outside edge 13 parallel to the short inside edge 11, and a short end edge 12 joining the short inside edge 11 to the short outside edge 13. The long portion 25 is also formed integral with the rear portion 23 extending therefrom preferably parallel to the short portion 24. Long portion 25 is defined by a linear long outside edge 15 and a long inside edge 17 parallel to the long outside edge 15. Long portion 25 has a length which extends longer than the short portion 24 relative to the rear portion 23 and terminates to form a directional indicator 16, which joins the long outside edge 15 to the long inside edge 17. When mat 1 is placed on the ground by a golfer, the directional indicator 16 is placed in direction of the intended golf shot by pointing the directional indicator 16 to the intended target. Directional indicator 16 can be an arrow, triangle, line or some other type of directional-indicating form.

Further describing its critical shape, mat 1 includes an arched edge 10 joining the short inside edge 11 to the long inside edge 17. Arched edge 10 is preferably arched and not linear to provide additional space behind a golf ball used with the instant mat 1, as will be discussed with reference to the additional features of mat 1. The arched edge 10 must provide spacing between the short portion 24 and long portion 25 that is slightly larger the size of the typical golf club head. A bottom edge 14 joins the short outside edge 13 to the long outside edge 15 to define the width of the rear portion 23. Accordingly, with all edges joined, a J-shaped mat 1 is formed having a distance between the short inside edge 11 of the short portion 24 and the long inside edge 17 of the long portion 25 defined by the arched edge 10. A channel 26 is thereby formed between the short portion 24 and the long portion 25 adapted to have a golf ball 30 situated therein and to receive a divot resulting from impact of the golf ball 30 by a golf club.

Along with the shape of the mat 1, also critical are some of the dimensions of the mat 1. As above, the distance between the short inside edge 11 and the long inside edge 17 must be slightly wider than the width of a golf club iron. Namely, the channel 26 formed between the short portion 24 and the long portion 25 has a width in the range of three to six inches, preferably between four and five inches. "Slightly" as used herein with reference to the width of the channel means the width provides enough space for the golf club to be swung through the channel 26 if the swing is on the proper plane, but not so much space that if the swing were off-plane significantly it would not strike the mat 1. Furthermore, it is critical that the short inside edge 11 of the short portion 24 has a length which is slightly longer than the length of a typically golf swing divot. Namely, the short portion 24 extends from the rear portion 23 at least six-inches, preferably in the range of eight to ten inches as measured from the middle of the arched edge 10. The average golf professional creates a divot that starts about ½ inch in front of the golf ball and extends approximately six inches, so "slightly" as used with reference to the length of the short portion 24 means the short portion 24 should extend just past this typical divot length of six inches so that the divot length and other properties can be evaluated with reference to the short portion 24.

A plurality of markings is disposed throughout the surface of the mat 1 to indicate ball position and divot position. Specifically, a pair of short iron indicators 19 is marked on the mat 1. One of the short iron indicators 19 is marked on the short portion 24 and one of the short iron indicators 19 is marked in opposing relation on the long portion 25. Each short iron indicator 19 is situated a distance of approximately two inches from the arched edge, "approximately" meaning between one and three inches. The bottom of this range is critical in that any less there is little to no room to hit the golf ball 30, i.e. the golf club would frequently hit rear portion 23 prior to impact. The top of the range can vary although if much larger than three inches the short portion 24 becomes excessively long. "Marked" as used herein to refer to an indicator means any kind of surface indicia on the top of the mat made by printing, etching, or otherwise, or any type of hole or punch-through of any shape which penetrates through the mat. In the embodiment shown, as an example only, each indicator is a triangular punch-through and being through the entirety of the mat 1, the mat 1 could be turned over and the indicators would still be visible by a left-handed golfer. The mat 1 can be used in either instance of a right-handed golfer or left-handed golfer, and if the indicators were only on the surface of the mat 1, the same type of indicators would be printed on the opposing side. Moreover, although shown in pairs it should be understood that only one of each indicator can be used, i.e. one or more.

Because short irons require a steeper descent and longer irons require a more shallow descent into the golf ball 30, also provided are middle iron indicators 19*a* and long iron indicators 18. Whereas to practice golf swings using short irons such as sand wedges, pitching wedges, or nine irons a golf ball is placed in alignment with the short iron indicators 19 more proximate to the arched edge 10, the pair of middle iron indicators 19*a* are used for mid-irons such as eight, seven, or six irons. In this instance the golf ball 30 would be placed near these markings. Thus, the long iron indicators 18 could be used for long irons such as five, four, and three irons, in which case the golf ball 30 is placed farther from the arched edge 10 to avoid impacting rear portion 23 of mat 1 (long irons travel through the impact zone a longer distance than short irons). In the preferred embodiment, each middle iron indicator is situated a distance of approximately three inches from the arched edge 10, and in turn each long iron indicator is situated a distance of approximately four inches from the arched edge. These dimensions may vary by an inch or so but it is preferred that the spacing between each indicator 19, 19*a*, 18 is approximately one inch.

Outermost from the arched edge 10 and thus closest to the end of short portion 24 is the divot indicator 40. Each divot indicator 40, whether in opposing pairs or singularly, is situated a distance from the arched edge 10 in the range of five to seven inches. The exact location of the divot indicator 40 is not critical but it must reside past each of the iron indicators 19, 19*a*, 18. The function of the divot indicator 40 is to act as a reference point for the divot which results from the swing of the golf club and the striking of the golf ball 30. For instance in the preferred embodiment the divot indicator 40 is marked at approximately six inches from the center of arched edge 10 so that after the divot is created, under typical golf course conditions the divot should reach to or past the divot indicator 40. Thus an appropriate divot would be straight within channel 26 and extend past the divot indicator 40 but not past the end of short portion 24. This is the critical range.

In use of the mat 1 then, the golfer places a golf ball 30 centered between either the short iron indicator 19, the mid-iron indicator 19*a*, or the long iron indicator 18. The closer the ball is in relation to the arched edge 10, the steeper the golf club must descend into the golf ball to avoid hitting the arched cutout 10 and striking the ball short inside in a descending blow. To still function appropriately because the distances vary only by approximately one inch, it should be understood that for short irons the golf ball 30 can be placed between either indicator 19 or between indicator 19*a*, for middle irons the golf ball 30 can be placed between indicator 19*a* and indicator 18, and for long irons the golf ball 30 can be placed between indicator 18 and even divot indicator 40 since for long irons the divot will either be short or near non-existent. In either instance an appropriate approximation of divot length is obtained because the divot will still extend between divot indicator 40 and the end of short portion 24. Once the golf ball 30 is struck, the golf club will create a divot starting slightly after where the ball was placed. When the mat 1 is used on a natural grass, the golfer can measure the divot length created with reference to the short portion 24 and long portion 25, and can also examine the divot direction with reference to both. As above, the average golf professional creates a divot that starts about ½ inch in front of the golf ball and extends approximately six (6) inches. The swing bottoms out approximately four (4) inches in front of the ball and the divot is deepest at this location. If the golfer looses this angle, or shaft lean, the golf club will strike the J shaped golf training mat 1. The golfer will also be forced to swing the golf club on a straight plane through the impact zone of the golf ball and release the energy stored by lagging the golf club head into the hack of the ball creating a divot after the golf ball 30. The golfer is also forced into a swing path that proceeds slight inside (before impact), to square (at impact), to slight inside (after impact) by forcing the club head path inside the J-shaped channel. If the golfer does not maintain this swing path, the golfer will strike the J-shaped golf training mat. This will improve the golfer's chance of scoring low by achieving proper impact dynamics.

Additional features include the mat's ability to be used by right-handed golfers or left-handed golfers by turning the mat 1 over, as referenced above. Furthermore, the mat 1 comprises one or more holes 21 defined throughout the mat 1 configured to receive and hold tees which can be used to hold down and maintain the mat on the natural surface.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. A golf swing training aid, comprising:

a rear portion;

a short portion integral with and extending from said rear portion defined by a linear short inside edge, a short outside edge parallel to said short inside edge, and a short end edge joining said short inside edge to said short outside edge;

a long portion integral with said rear portion extending therefrom parallel to said short portion defined by a linear long outside edge and a long inside edge parallel to said long outside edge, said long portion having a length which extends longer than said short portion relative to said rear portion, said long portion terminating to form a directional indicator joining said long outside edge to said long inside edge;

an arched edge joining said short inside edge to said long inside edge;

a bottom edge joining said short outside edge to said long outside edge to define a width of said rear portion, thereby forming a J-shaped mat having a distance between said short inside edge and said long inside edge defined by said arched edge to define a channel between said short portion and said long portion adapted to have a golf ball situated therein and to receive a divot after said golf ball is impacted;

a pair of short iron indicators marked on said mat, one of said short iron indicators marked on said short portion and the other of said short iron indicators marked in opposing relation on said long portion, each said short iron indicator situated a distance of approximately two inches from said arched edge;

a pair of middle iron indicators marked on said mat, one of said middle iron indicators marked on said short portion and the other of said middle iron indicators marked in opposing relation on said long portion, each said middle iron indicator situated a distance of approximately three inches from said arched edge;

a pair of long iron indicators marked on said mat, one of said long iron indicators marked on said short portion and the other of said long iron indicators marked in opposing relation on said long portion, each said long iron indicator situated a distance of approximately four inches from said arched edge; and, a pair of divot indicators marked on said mat, one of said divot indicators marked on said short portion and one of said divot indicators marked in opposing relation on said long portion, each said divot indicator situated a distance of approximately five inches from said arched edge.

2. The golf swing training aid of claim 1, wherein said distance between said short inside edge and said long inside edge is slightly wider than a width of a golf club iron.

3. The golf swing training aid of claim 1, wherein said short inside edge of said short portion has a length which is slightly longer than a length of a golf swing divot.

4. The golf swing training aid of claim 3, wherein said short inside edge of said short portion is approximately eight inches long such that short end edge of said short portion is situated a distance of approximately eight inches from said arched edge.

5. The golf swing training aid of claim 1, further comprising a plurality of holes defined through said mat.

6. A golf swing training aid, comprising:

a rear portion;

a short portion integral with and extending from said rear portion defined by a linear short inside edge, a short outside edge parallel to said short inside edge, and a short end edge joining said short inside edge to said short outside edge;

a long portion integral with said rear portion extending therefrom parallel to said short portion defined by a linear long outside edge and a long inside edge parallel to said long outside edge, said long portion having a length which extends longer than said short portion relative to said rear portion, said long portion terminating to form a directional indicator joining said long outside edge to said long inside edge;

wherein each said rear portion, said short portion, and said long portion are non-opaque such that textures on a natural surface remain visible when said aid is placed on said natural surface;

a non-linear, arched edge joining said short inside edge to said long inside edge, said arched edge curved to define additional space between a golf ball and said rear portion to avoid contact with said rear portion when said golf ball is placed between said short inside edge and said long inside edge and struck by a golf club; and, a bottom edge joining said short outside edge to said long outside edge to define a width of said rear portion, thereby forming a J-shaped mat having a distance between said short inside edge and said long inside edge defined by said arched edge to define a channel between said short portion and said long portion adapted to have said golf ball situated therein and to receive a divot after said golf ball is impacted.

7. The golf swing training aid of claim 6, wherein said mat is flexible.

8. The golf swing training aid of claim 6, further comprising a plurality of holes defined through said mat configured to receive golf tees such that said mat can be secured to said natural surface using said golf tees.

* * * * *